United States Patent [19]

Janne

[11] 4,047,378

[45] Sept. 13, 1977

[54] MACHINE FOR FORMING A BISMARCK CHAIN

[76] Inventor: Jouko Janné, 32700 Lauttakyla, Finland

[21] Appl. No.: 690,612

[22] Filed: May 27, 1976

[51] Int. Cl.[2] ..... B21L 7/00

[52] U.S. Cl. ..... 59/20

[58] Field of Search ..... 140/3 B, 92.3, 92.4, 140/92.7, 92.94; 59/20; 245/6; 72/135, 137

[56] References Cited

U.S. PATENT DOCUMENTS 1,100,098 6/1914 Richter ..... 140/3 B

FOREIGN PATENT DOCUMENTS 329,030 11/1920 Germany ..... 59/20

*Primary Examiner*—Lowell A. Larson
*Attorney, Agent, or Firm*—Christie, Parker & Hale

[57] ABSTRACT

A machine for forming a Bismarck chain has first and second wire twisting heads alternately feeding and turning two wire helices disposed at an angle of about 90° to each other. The first head adds a first helix of wire as a new link to the last link of the chain, and the second head adds a second helix of wire as a new link to the first helix. The first and second helices are cut after their formation. Thereafter, the chain is pulled upwardly away from the wire twisting heads a distance of two chain lengths. The last length in the chain is held above the wire twisting heads as the wire twisting heads feed and turn two new wire helices.

8 Claims, 9 Drawing Figures

MACHINE FOR FORMING A BISMARCK CHAIN

The present invention concerns a machine for forming a Bismarck chain in which the end of one helix formed of silver, gold or equivalent wire is intertwined by rotation with another wire helix and the helical chain links thus fixed together are cut off to pieces of given length, and in this manner helical links are attached to the chain being formed.

Up to now the forming of Bismarck chains has been performed manually. Hereby the making of such chain is slow and the labour costs constitute a considerable proportion of the price of the completed chain. In spite of all efforts so far, no machine could be developed by means of which this twisting step could be performed completely automatically.

The object of the invention is to eliminate this shortcoming and to provide a machine by which the forming of a Bismarck chain is rapidly and automatically accomplished.

This object is achieved on the basis of the characteristic features of the invention specified in the attached claims.

Figures 1, 1A:
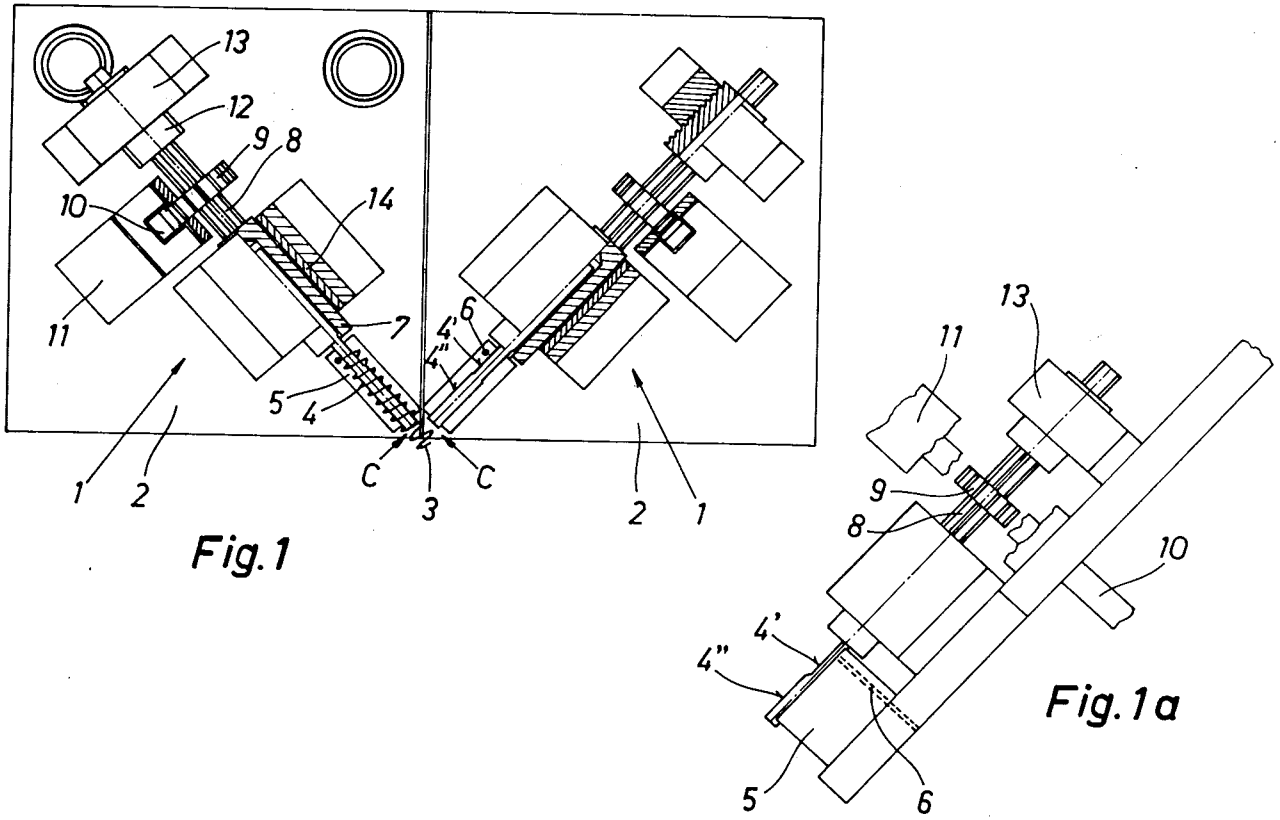

The invention is described in detail in the following with reference to the attached drawings, wherein FIG. 1 presents the twisting heads according to an embodiment of the invention, viewed from above, and FIG. 1*a* shows in elevational view a twisting head of FIG. 1.

Figure 2:
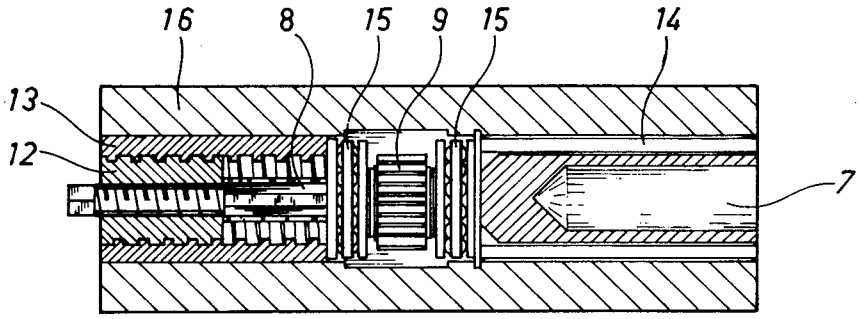

FIG. 2 shows, sectioned, part of a twisting head according to a preferred embodiment of the invention.

Figure 3A:
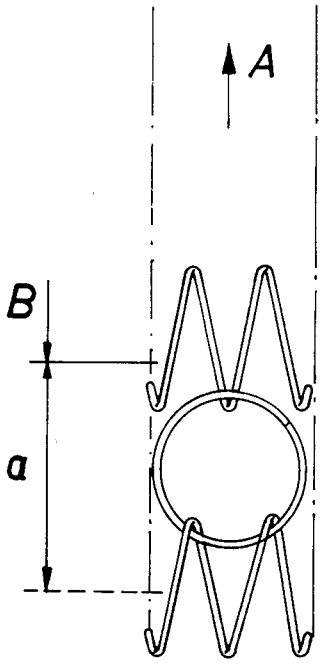

FIG. 3*a* shows three helical links twisted together, and

Figure 3B:
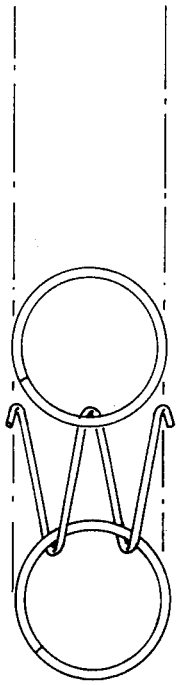

FIG. 3*b* shows the same, turned through 90°.

Figure 3C:
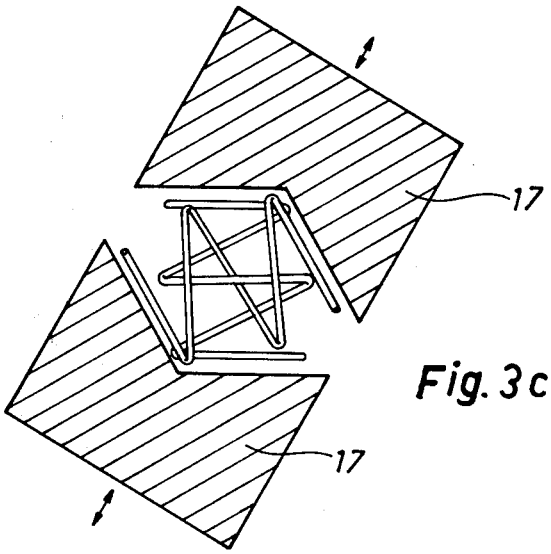

FIG.3*c* shows the joined helical links, viewed from the top and in the chain holding jaws.

Figure 4A:
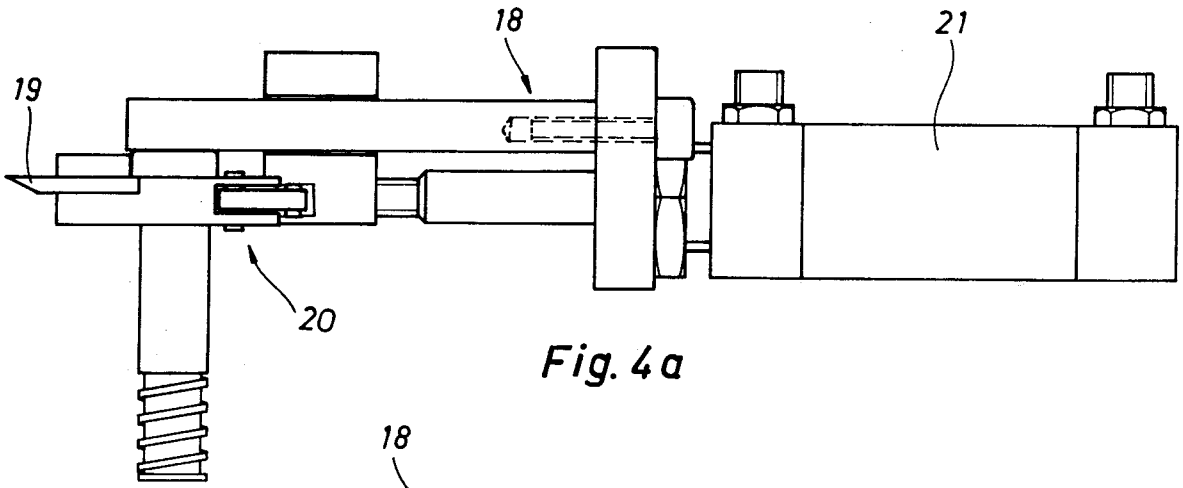
Figure 4B:
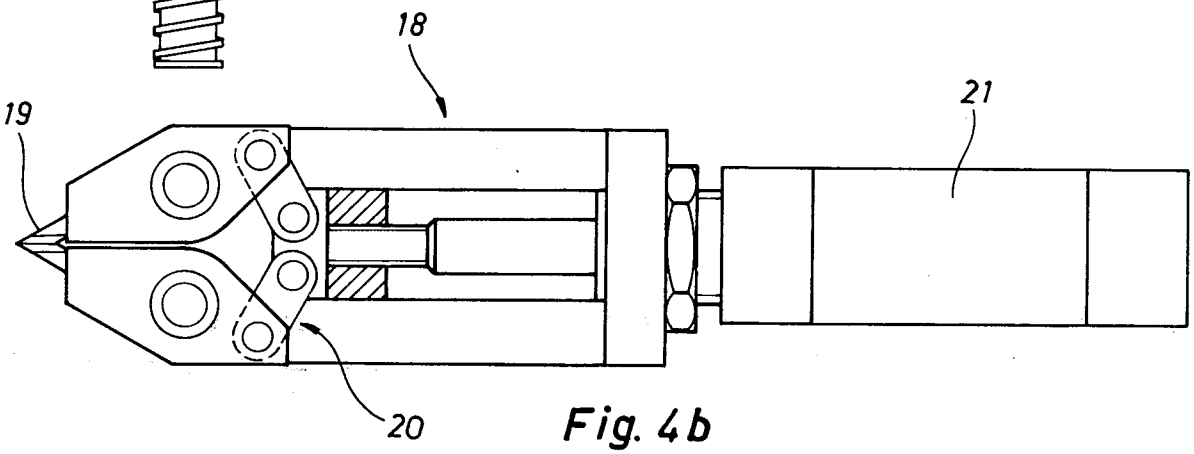

FIGS. 4*a* and 4*b* display the helix wire cutting device.

Figure 5:
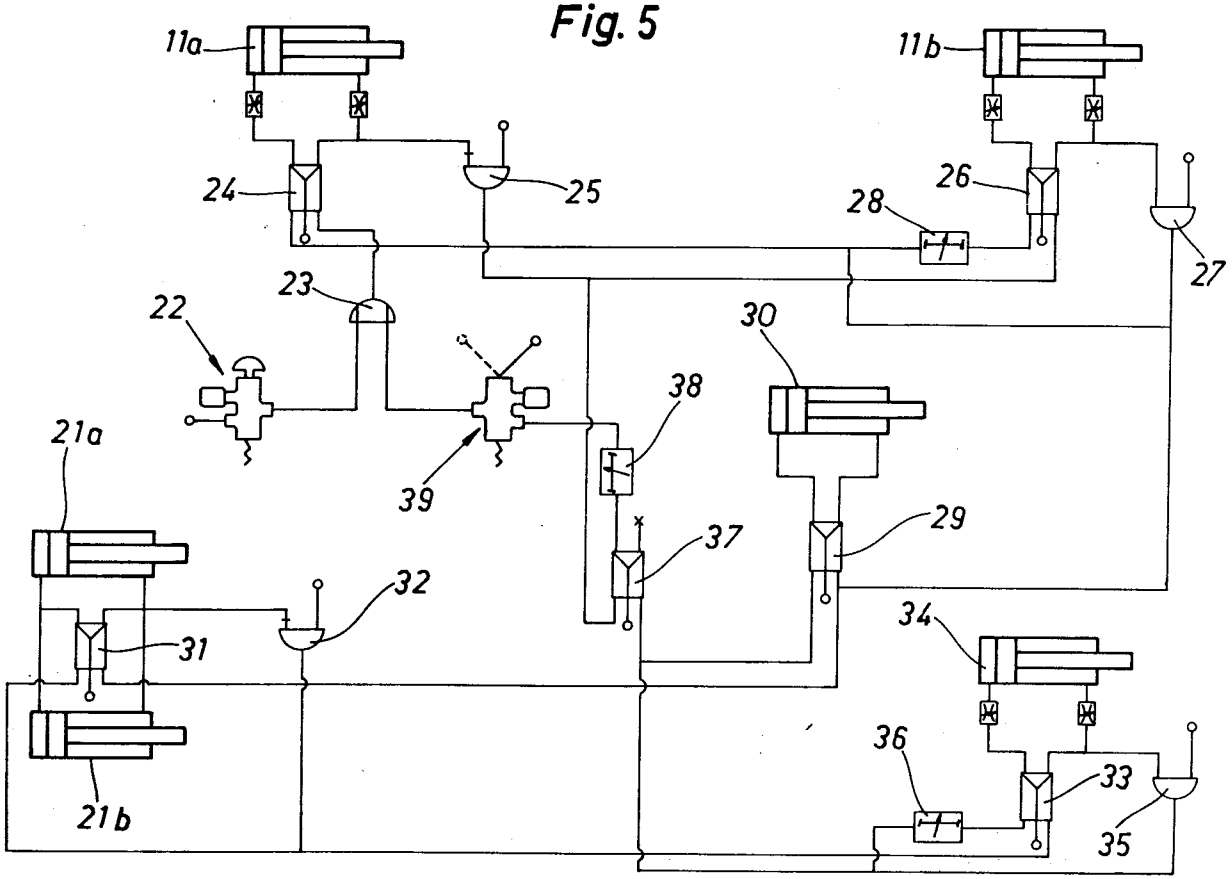

FIG. 5 shows the pneumatic circuit diagram of the apparatus.

In FIG. 1, two twisting heads 1 placed at a 90 degree angle with reference to each other are shown, which have been mounted on separate tables 2. The height of the tables with reference to each other in the vertical direction, i.e. at right angles to the plane of the drawing, is adjustable. A silver, gold or equivalent wire is shaped to a helix 3 around the pin 4. The wire is fed through the hole 6 in the base of the pin 4. The pin 4 is reciprocally rotated a given number of turns, in the present case from 2¼ to 2½ turns, at a time in one direction, and at the same time the pin 4 is advanced in axial direction as much as the pitch of the helix 3 requires. The seating part of the pin 4 has been mounted with a press fit in the sleeve 7. The sleeve 7 is integrally connected with the shaft 8, which passes through the gear wheel 9 with a sliding groove fit. It is thus understood that the shaft 8 may slide axially through the gear wheel 9, but is rotated by the gear wheel 9 by form fit engagement. The gear wheel 9 is rotated in reciprocal fashion by means of the gear rack 10, which moves in the plane perpendicular to the drawing. The gear rack 10 is operated by a pneumatic piston-and-cylinder means 11. The shaft 8 carries on its end a feed screw 12 with external threads, its threads in engagement with the internal threads of the feed sleeve 13. The sleeve 7 has been fitted to be inside the slide bearing 14. When the gear rack 10 is used to produce by its reciprocating motion the rotation of the gear wheel 9, the above-mentioned movement of the pin 4 results therefrom.

FIG. 2 shows a mechanism for producing the motion of the pin, according to a preferred embodiment of the invention. In this Figure the same reference numerals as in FIG. 1 have been used for identical components. The gear wheel 9 is solidly carried rotatably between the bearings 15, through which the slide groove shaft 8 associated with the sleeve 7 passes. The feed screw 12 has been affixed by threads to the end of the shaft 8, and the feed sleeve 13 has been mounted with a press fit in the body 16. It is thus easy to replace the components 12 and 13 by other components having a different feed thread pitch. It is likewise easy to fit in the sleeve 7 different diameter pins 4. One machine is thus usable with minor changes to make chains of different sizes.

When in the manner described above the reciprocating rotation of the pin 4 and its simultaneous axial motion is produced, this has the consequence that when the rotation of the pin is in the direction in which the helix has been wound, the least frictional adherence between the helix 3 and the pin 4 already suffices to cause the tightening of the helix around the pin 4, so that the helix will rotate along with the pin. In contrast, rotation of the pin in the direction in which the helix opens will open, or relieve, the helix and thereby detach it from its frictional adherence to the pin, whereby the pin 4 may rotate freely in the direction of opening of the helix without taking the helix along. This is how the periodic feed of the helix 3 in increments of the desired number of turns is achieved, in this case the amount of 2¼ to 2½ turns already mentioned. The adherence of the helix 3 to the pin 4 during its feeding period has been enhanced in that the part of the pin 4′ where the winding of the wire to a helix takes place has a slightly smaller diameter than the part 4 inches of the pin from there to the twisting point. This causes the wire helix 3 always to be pressed with sufficient pre-stressing around the pin part 4 inches so that the friction is sufficient to take the wire helix along. When the pin is rotated in the winding direction of the helix, the pressure between the helix and the pin increases, and at the same time also the frictional force. When the pin is rotated in the opening direction of the helix, the pressure is reduced and at the same time also the frictional force, as the inner diameter of the helix increases in its tendency to open out. It is possible to use instead of the thicker diameter part 4 inches of the pin 4, any kind of eminences or a roughened surface, in order to produce the frictional adherence.

When the left twisting head has reached the outermost feed position shown in FIG. 1, it stops. Subsequently, the right twisting head performs the feed motion and arrives in the extreme position shown in FIG. 1 (the wire helix has not been depicted). When the right feeding head is positioned one diameter of the helix, or a slightly smaller distance (in the direction perpendicular to the plane of the drawing) lower than the left feeding head, this has the consequence that the right twisting head will twist the helix to run across the left helix. The wires are then cut at the point C and the twisting heads are returned to their starting positions by movement of the racks 10. The sequence may also be the opposite, in that the feeding heads are returned and the cutting of the wire is done thereafter. The consequence of this step in the operation is that two pieces of helix attached to each other are formed. By moving the chain which is in the process of being formed upwardly as much as the diameter of two helix turns, i.e., adistance equal to two links of the chain, the chain can again be enlarged by repeating the step (i.e., the twisting motion of both twisting heads) to form another two helix links.

FIGS. 3*a* to 3*c* present the chain consisting of the helical links. A chain pulling means, which is depicted in FIG. 5 as cylinders 30 and 34, is used to pull the chain in the direction A periodically the distance a, which as shown equals the length of two helical links. The last link of the chain being formed is secured between dovetail-shpaed jaws 17. If FIGS. 3*a* and 3*b* are assumed to present the situation wherein the two lowest helix links have just been formed but the chain pulling means has not yet operated, the lower ends of the holding jaws 17 are on the level B. When the chain pulling means pulls the chain along upwardly through the distance *a*, the lowermost helix link is secured between the jaws 17, whereby it is possible to introduce in it the next helix 3 and prior to its cutting still another helix may be introduced into the last-mentioned helix. Both introduced helices are then simultaneously cut, whereby once again a length of chain equivalent to two helix diameters, i.e., two links, has been formed.

As can be seen from FIGS. 3*a* and 3*b*, every second introduction (the upper one in the figure) is done so that only one wire is crossed and the second (in the figure, the lower), so that two wires cross. This is possible by appropriate choice of the height at which the chain pulling means stops the chain and the mutual difference in height between the twisting heads, and the wire cutting points C. FIGS. 4*a* and 4*b* show an embodiment example of the wire cutting means 18. In this, the cutting hits 19 have been arranged to open by a pincer-like motion and to close by means of the linkage 20, which is actuated by the pneumatic piston-and-cylinder means 21. Since the axial feed motion of the helix wire is in accordance with its helical pitch, the helix wire is able to pass through between the opened bits 19. The cutting means 18 may then be immovably mounted.

Referring now to FIG. 5, the pneumatic operation of the apparatus shall next be described. The input of compressed air is at the points indicated by small circles. When the start button 22 is depressed, the OR logics valve 23 controls the valve 24 to assume the state in which it admits the compressed air to the end opposite to the piston rod of the piston-and-cylinder means 11*a* operating the first twisting head. The operation of the piston-and-cylinder means 11*a* then produces the feed motion of the first twisting head. When the piston of the piston-and-cylinder means 11*a* has travelled the pre-set distance and meets the stop, the pressure stops acting on the NOT logics valve 25 at its input, and the pressure is admitted through the valve 26 controlled by the valve 25 to the piston-and-cylinder means of the second twisting head 11*b*, causing the feed motion of the second twisting head. When the piston of the piston-and-cylinder means 11*b* meets the stop and the pressure disappears at the input of the NOT logics valve 27, a control pressure is derived from the valve 27 to return the first twisting head (through the valve 24 to the piston rod side of the piston-and-cylinder means) and after e.g. half a seconds delay over the delay element 28 for the return of the second twisting head (through the valve 26 to the piston rod side of the piston-and-cylinder means 11*b*). In addition, from the valve 27 the control pressure is derived for the valve 29, which admits compressed air to the piston-and-cylinder means 30, which causes the chain pulling means to grasp the chain, and compressed air is simultaneously supplied through the valve 31 to the actuating cylinders 21*a* and 21*b* of both wire cutting means. When the pistons of the cylinders 21*a* and 21*b* meet their stops, the pressure at the input of the NOT logics valve 32 disappears, whereby from the valve 32 a control pressure is derived, firstly to the valve 31 for returning the wire cutting means to their initial position, and secondly to the valve 33, which admits compressed air to the actuating cylinder 34 of the wire pulling means causing the chain to be pulled in the direction of the arrow A in FIG. 3*a* through the distance *a*. When the piston of cylinder 34 meets its stop, the pressure at the control input of the NOT logics valve 35 disappears, whereby from the valve 35 the control pressure is derived for the valve 29 for release of the chain from the chain pulling means and through a half-second delay element 36, to the valve 33 in order to return the chain pulling means to its initial position. Furthermore, from the valve 35 the control pressure is obtained for the valve 37 in order to bring it into the state wherein the compressed air is admitted through the valve 37 and through the delay element 38 causing a delay of e.g. one second, to the automatic valve 39. If the valve 39 has been opened in order to make the machine operate continuously on automatic, the control pressure goes from the OR logics valve 23 to the valve 24, whereupon the steps just described are repeated. If the automatic valve 39 is closed, the operation stops. It is then possible by depressing the start button 22 to start the machine for one operational cycle at a time.

It is understood that the invention is not confined to the embodiment example presented above, but its structural solutions may even considerably deviate within the scope of the claims following below.

For instance, it is possible instead of two feeding heads to use one single feeding head, which is in the different operational steps turned through 90° and at the same time is displaced in a direction perpendicular to the turning plane nearly through a distance equal to one helix turn diameter. This may be accomplished by performing the turning, first about an axle provided with a thread of appropriate pitch. The feed motion of the twisting pin 4 may also be produced by elements other than those shown in FIGS. 1 and 2. The pin 4 may, for instance, connect directly with a piston rod moving in its axial direction and provided with a thread and moving through a sleeve with internal threads in order to produce the requisite turning motion.

I claim:

1. Machine for twisting a Bismarck chain in that the end of a helix formed of silver, gold or equivalent wire is intertwined by rotation crosswise with another helix and the helices thus affixed to each other are cut into pieces of a given length and the attachment of helical pieces is continued in the same manner, the machine comprising two twisting heads (1) each having a pin (4), around which the wire helix (3) can be formed and which has been arranged to be reciprocatingly turnable and to be simultaneously reciprocatingly fed in its axial direction, the two twisting head (1) being arranged to feed periodically in turns and simultaneously to turn two wire helices (3), the twisting heads (1) being positioned at an angle of about 90 degrees with reference to each other in two planes having a mutual vertical distance substantially equal to the inner diameter of the helix turn or slightly less; a wire cutting means (18) immediately adjacent to the ends of the feeding pins (4) (C) whereby the termination of the feed motion of the first twisting head starts the feed motion of the second twisting head, and the termination of the feed motion of the second twisting head starts operation of the wire cutting means (13, 21*a*, 21*b*), the machine further comprising a chain pulling means (30, 34) grasping the chain and pulling it upwards, and a pair of chain holding jaws (17) extending upwards from the ends of the feeding pins and forming therebetween a space corresponding to the outline configuration of the chain so that the chain can slide therethrough, the lower ends of the chain holding jaws (17) being at such a level (B) that more than two but less than three helix pieces are below that level before operation of the chain pulling means.

2. A machine for forming a Bismarck chain having a first wire twisting head and a second wire twisting head alternately feeding and turning two wire helices disposed at an angle of about 90° to each other, the first head adding a first helix of wire as a link to the last link of the chain, and the second head adding a second helix of wire as a link to the first helix, and means for cutting the helices formed by the wire twisting heads, wherein theimprovement comprises:

means for pulling the chain upwardly away from the wire twisting heads a distance of two chain links after each time the wire cutting means cuts the helices; and means above the wire twisting heads for holding the last link in the chain as the wire twisting heads feed and turn two new wire helices.

3. The machine of claim 2, in which the twisting heads each have a pin around which the wire helix is wrapped prior to feeding and turning the helix such that the wire feeds from a first end of the pin toward a second end of the pin where feeding and turning takes place, the first end of the pin having a slightly smaller diameter than the second end of the pin.

4. The machine of claim 2, additionally comprising first and second tables on which the first and second wire twisting heads are respectively mounted, the height of at least one of the tables being adjustable.

5. The machine of claim 2, in which the cutting means comprises a pair of bits for each wire helix and each wire helix is arranged to be fed between the bits of the cutting means.

6. The machine of claim 2, in which the chain pulling means is actuated reponsive to the end of the actuation of the wire cutting means.

7. The machine of claim 6, in which the second wire twisting head is actuated responsive to the end of the actuation of the first wire twisting head.

8. The machine of claim 7, in which the first wire twisting head is actuated responsive to the end of the actuation of the chain pulling means.

* * * * *